United States Patent [19]

Steinke

[11] Patent Number: 4,651,637

[45] Date of Patent: Mar. 24, 1987

[54] APPARATUS FOR CLASSIFYING JUICE SQUEEZED FROM GRAPES

[75] Inventor: Dale F. Steinke, Guerneville, Calif.

[73] Assignee: F. Korbel and Bros., Guerneville, Calif.

[21] Appl. No.: 823,938

[22] Filed: Mar. 6, 1986

Related U.S. Application Data

[63] Continuation of Ser. No. 643,427, Aug. 8, 1984, Pat. No. 4,587,896.

[51] Int. Cl.[4] ..... B30B 9/14

[52] U.S. Cl. ..... 100/117; 100/127; 100/131; 99/496

[58] Field of Search ..... 100/116, 117, 126, 127, 100/130, 131, 132, 134, 135, 136, 145–150, 37; 99/495, 496

[56] References Cited

U.S. PATENT DOCUMENTS

| | | | |
|---|---|---|---|
| 806,991 | 12/1905 | Oliver | 100/131 X |
| 925,971 | 6/1909 | Wheelwright | 100/148 X |
| 1,971,546 | 8/1934 | Tuttle | 100/130 X |
| 3,113,161 | 12/1963 | Schmalenbach | 100/117 X |
| 3,997,441 | 12/1976 | Pamplin, Jr. | 100/117 X |

*Primary Examiner*—Peter Feldman

*Attorney, Agent, or Firm*—Schapp and Hatch

[57] ABSTRACT

Apparatus for separating and collecting different grades of grape juice from a continuous action, inclined helical screw dejuicer having a plurality of drip pans below the dejuicer barrel formed to convey different grades of grape juice to receiving troughs, at least some of the drip pans being adjustable longitudinally of the dejuicer barrel for selectively varying the nature and quality of the juice collected by each adjustable drip pan. The method contemplates adjusting the quality of each grade in the manner described, making it possible to collect the "first press" clear, uncolored juice pressed from colored grapes so as to be able to make white wine from red grapes.

6 Claims, 9 Drawing Figures

APPARATUS FOR CLASSIFYING JUICE SQUEEZED FROM GRAPES

This is a continuation of co-pending application Ser. No. 06/643,427 filed on Aug. 8, 1984 now U.S. Pat. No. 4,587,896.

BACKGROUND OF THE INVENTION

1. Field of the Invention

This invention relates to methods and apparatus for separating and collecting different grades of grape juice from a continuous action dejuicer, and more particularly to the structure and method of use of drip pans.

In the making of grape juice, wine and other spiritous liquors from grapes it is usually necessary to separate the grape juice from the pulp, skin and seeds. Originally this was accomplished by pressing or squeezing the grapes and then removing the pulp, skin and seeds from the juice. As the Industrial Revolution proceeded, various kinds of mechanical presses were made, culminating in a continuous action "dejuicer" having an elongated perforated cylindrical barrel within which a helical screw rotates so as to force grapes constantly being fed into the entrance end of the barrel through the barrel against resistance at the discharge end, thus expressing the juice from the pulp, seeds and skins through the perforations before the pulp, seeds and skins are extruded from the discharge end of the dejuicer.

Conventionally, the barrel of the dejuicer is inclined with the entrance end lower than the discharge end. As the grapes are urged upwardly up the barrel by the helical screw, they are first pressed lightly and then with increasing force as they progress upwardly through the cylindrical barrel. The lightly pressed juice (corresponding to the "first pressing" from wine presses) is considered to be of the highest grade, with the grade quality decreasing as more and more pressure is exerted on the grapes.

In an attempt to segregate or "classify" the different grades of juices passing through the perforations of the dejuicer barrel, a series of circumferential flanges perpendicular to the axis of the barrel and helical screw are affixed to the exterior of the barrel so that the lower quality juices from the upper end of the barrel will not flow downwardly along the exterior of the inclined barrel to mix with the higher grade juices.

Conventional dejuicers have sheets of metal (called "drip pans") fastened beneath the dejuicer barrel to intercept and channel juices dropping therefrom to troughs which are in turn connected by conduits to storage tanks or other wine making apparatus.

SUMMARY OF THE INVENTION

The present invention is directed to improvements in the drip pan collectors and in the methods of using same to achieve classification of the different grades of juices as desired by the user.

The apparatus of the present invention makes possible much more precise classification and separation of the grape juice into different grades by making certain of the drip pans longitudinally adjustable with respect to the dejuicer barrel.

Different grapes have different pressing characteristics and the adjustable drip pans of the present invention make it possible to accomodate the apparatus to the differing qualities of juices pressed from various types of grapes. Also, certain wines and other products made from the grape juice require higher or lower quality grades than those conventionally provided by fixed drip pan construction.

The apparatus of the present invention makes practicable the method of the present invention which in turn makes it possible to produce white wine from red grapes processed in a cylindrical, continuous flow dejuicer. Typically, the first and lightest pressing of colored grapes results in a clear, non-colored juice. This juice may be processed into a "white" non-colored wine, and this is made possible by collecting the juice from the dejuicer only at the position therealong where only clear, non-colored juice is expressed through the perforations in the dejuicer barrel.

Accordingly, it is a principle object of the present invention to provide drip pan apparatus for collecting grape juice from a continuous operation cylindrical dejuicer, classifying the juice into desired grades, and supplying the different grades to desired storage tanks or other wine making equipment.

Another object of the present invention is to provide an apparatus of the character described which is adjustable in such manner as to permit the user to vary the classified grades of juice according to the use intended and according to the variety and physical characteristics of the grapes being dejuiced.

A further object of the present invention is to provide an apparatus capable of separating clear, non-colored juice from the colored juice being removed from colored grapes.

A still further object of the present invention is to provide a method wherein the clear, non-colored juice is utilized to make a "white" non-colored wine.

Other objects and features of advantage will become apparent as the special occasion progresses and from the claims.

Figure 1:
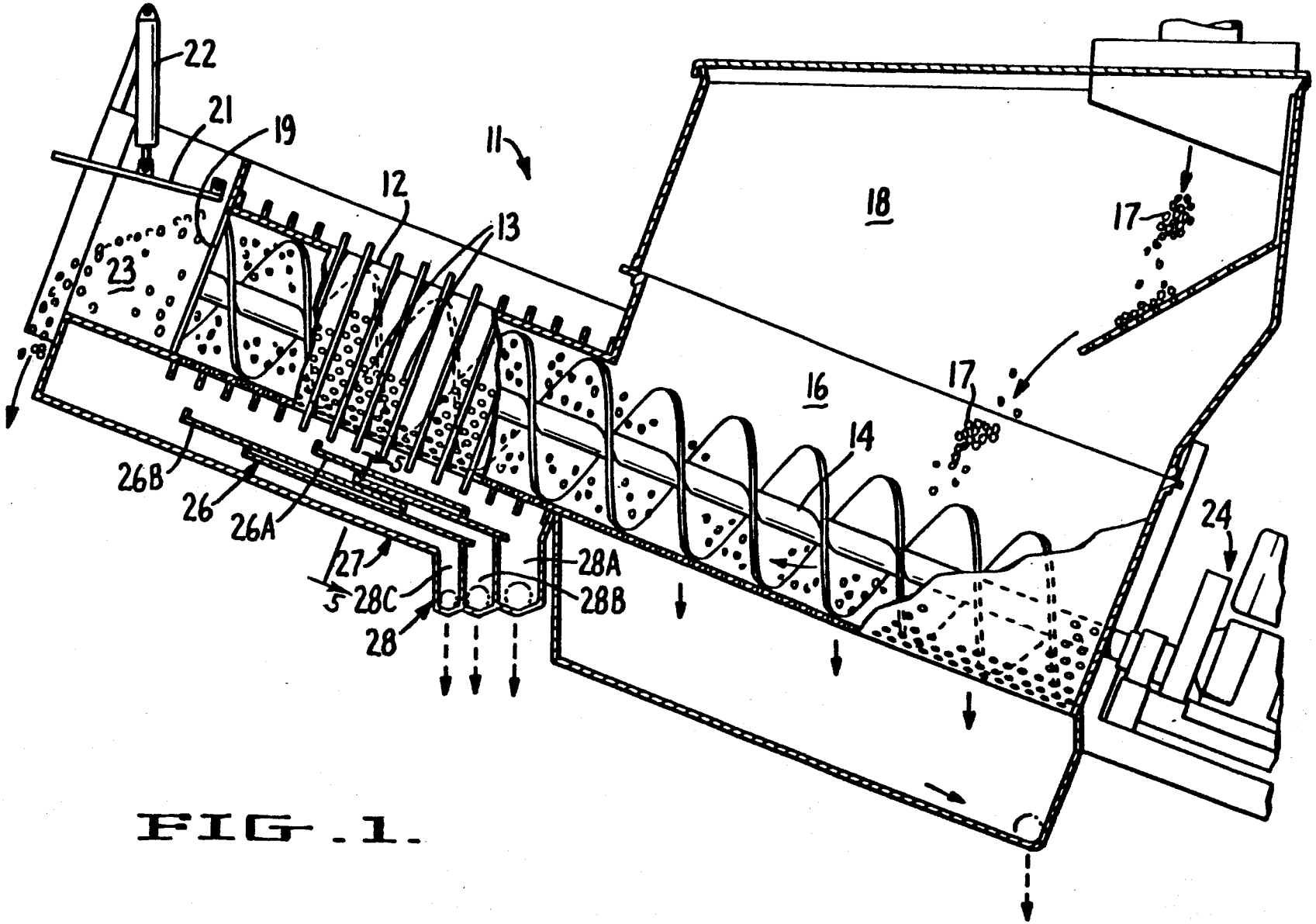
FIG. 1 is a side elevational view of an apparatus constructed in accordance with the present invention and shown in operative association with a cylindrical barrel dejuicer, portions of the view being broken away and shown in section for clarity of illustration.

While only the preferred form of the invention is illustrated in the drawings, it will be apparent that various modifications could be made without departing from the ambit of the claims.

DESCRIPTION OF THE PREFERRED EMBODIMENTS

As may be seen in the accompanying drawings, the drip pan apparatus of the present invention is designed for use in connection with a grape dejuicing machine having a cylindrical barrel formed with a plurality of perforations therethrough and an expressor screw formed with helical flights rotatable therein for squeezing grapes fed into said barrel to extract their juice. Conventionally, and as here shown, the barrel 12 is inclined and at its lower end 16 opens upwardly to receive grapes 17 from a hopper 18.

The upper, outlet end 19 of the barrel 12 is provided with a swinging door 21 movable by a hydraulic piston 22 against the solid remains 23 so as to create back pressure against movement of the grapes 17 through the barrel 12, causing the grapes to be pressed gently at first and then harder and harder as they progress through the barrel 12 to the outlet end 19. A suitable motor drive 24 rotates the helical screw expressor 14.

In accordance with the present invention, a plurality of substantially parallel flattened juice receiving drip pans are carried on support means 27 formed for supporting the pans 26 in inclined generally parallel and vertically spaced relation underneath the portions of the barrel 12 from which juice emanates during squeezing of the grapes 17.

A plurality of open top receiving troughs 28 are mounted to extend transversely of the barrel 12 in side-by-side relation beneath the lower ends of the pans 26 to receive juice therefrom, at least one of the pans 26A being slidably adjustable on the support means 27 so as to receive "first pressing" juice from said barrel up to a desired station therealong, and to deflect such juice into one of the receiving troughs 28A. A flattened trough 29 extends along the barrel 12 from the upper end 19 thereof below the drip pans 26, the flattened trough 29 being formed for receiving the juice from the barrel not deflected by the drip pans and for channeling such juice to another of the receiving troughs, 28C.

The slidably adjustable drip pan 26 is hereby supported at its longitudinal sides by brackets 31 and at its lower end by flange 36 resting on the fixed pan 26 immediately subjacent slidable pan 26A, the fixed pan 26 being secured by bolts 30 to bracket 31. Slidably adjustable drip pan 26B is supported at its lower end by a depending flange 36B which rests on the subjacent fixed drip pan 26, and is supported at its upper end on a bracket 32 secured to flattened trough 29. Support is provided for the flattened trough 29 at one side thereof by hooking over a rod 33 forming part of the structure of support means 27. A latch 35 on support means 27 releasably supports the other side of flattened trough 29 so the latter can be swung downwardly for cleaning. The fixed drip pan 26 immediately subjacent adjustable drip pan 26B is supported on flattened trough 29 by means of legs 40.

Figure 2:
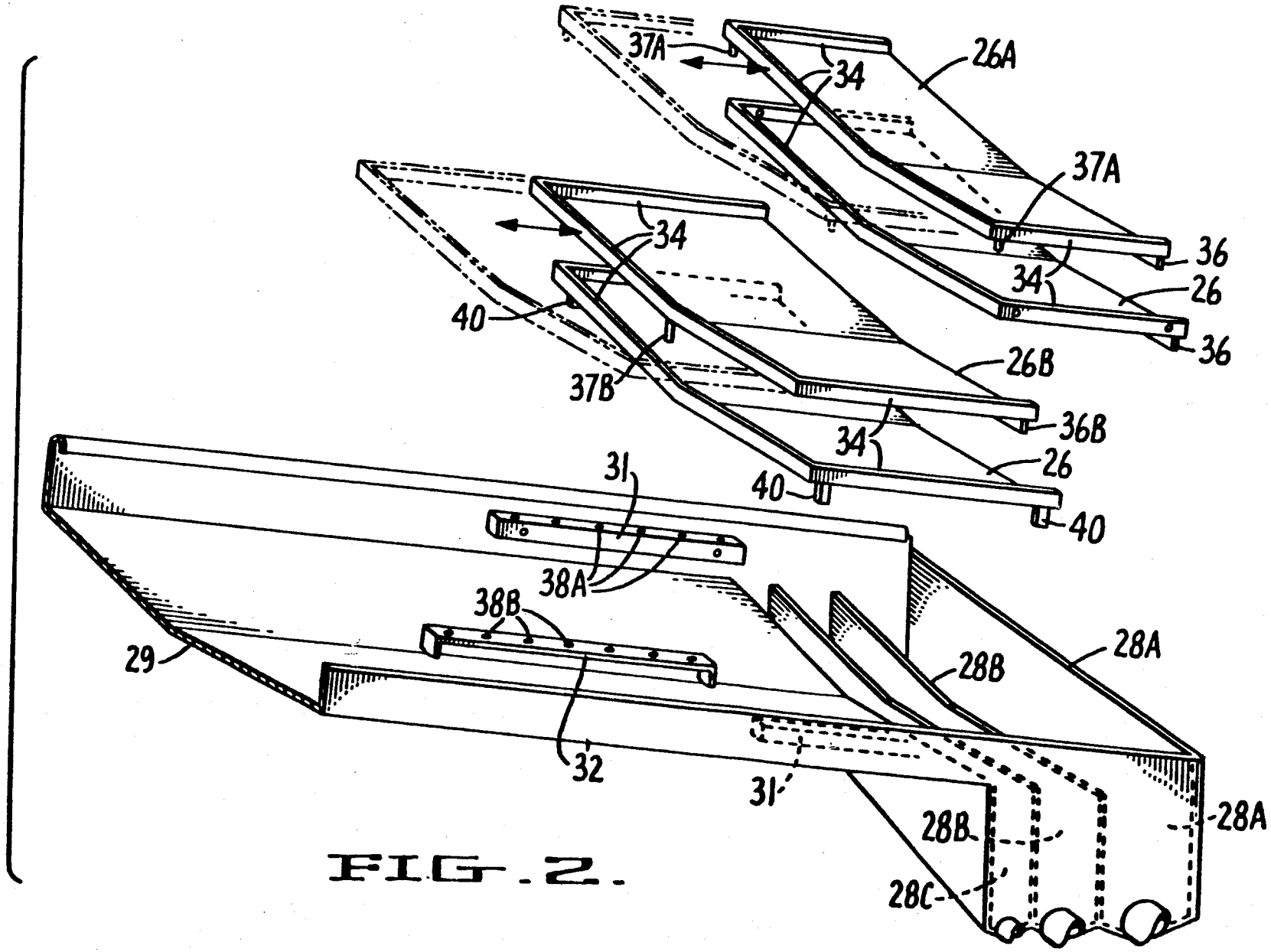
FIG. 2 is an exploded perspective view on an enlarged scale of a plurality of drip pans constructed in accordance with the present invention and their underlying support structure.
Figures 3, 4:
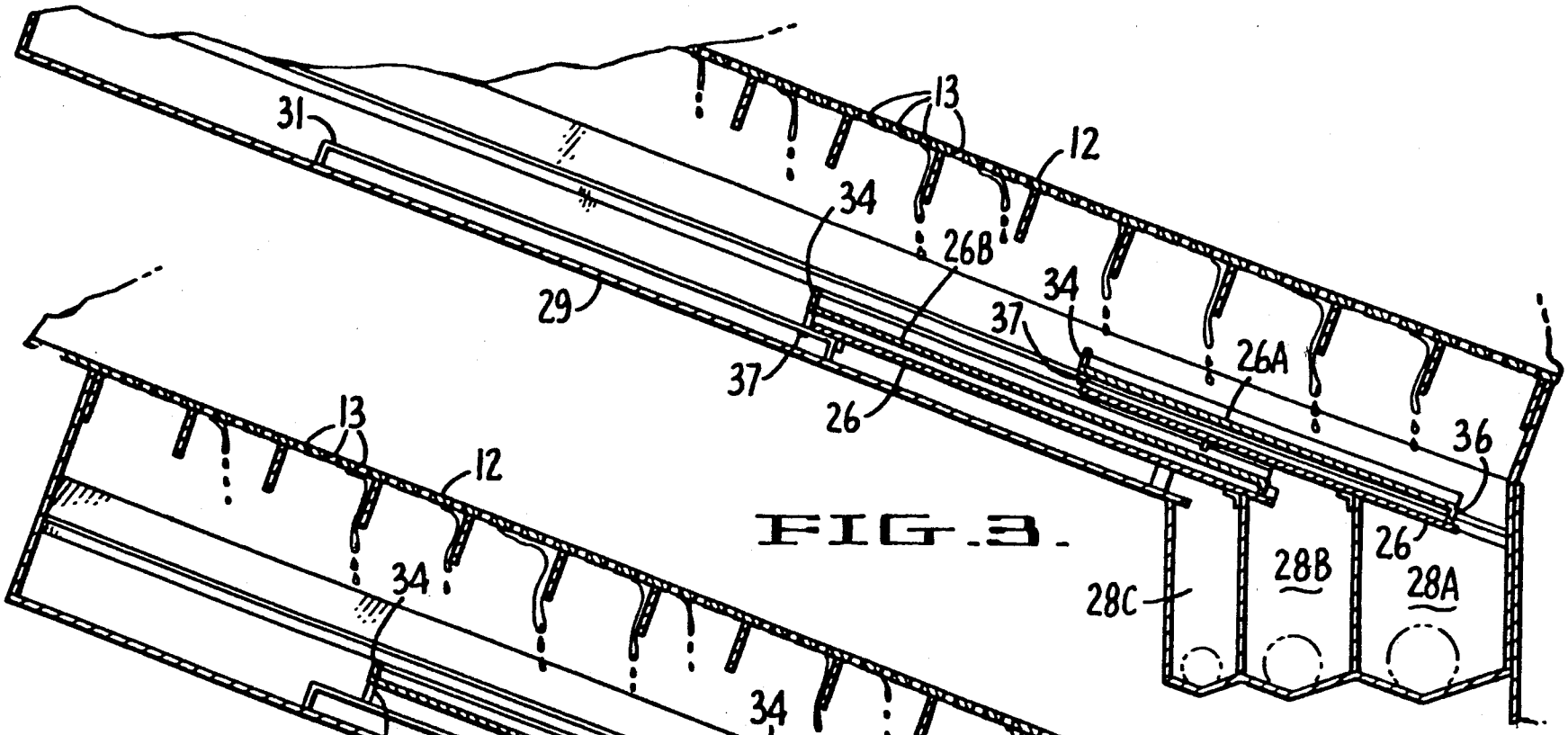
FIG. 3 is a vertical cross-sectional view on a reduced scale taken substantially on the plane of line 3—3 of FIG. 5.
FIG. 4 is a view similar to that of FIG. 3, but showing the adjustable drip pans in a different position.
Figure 5:
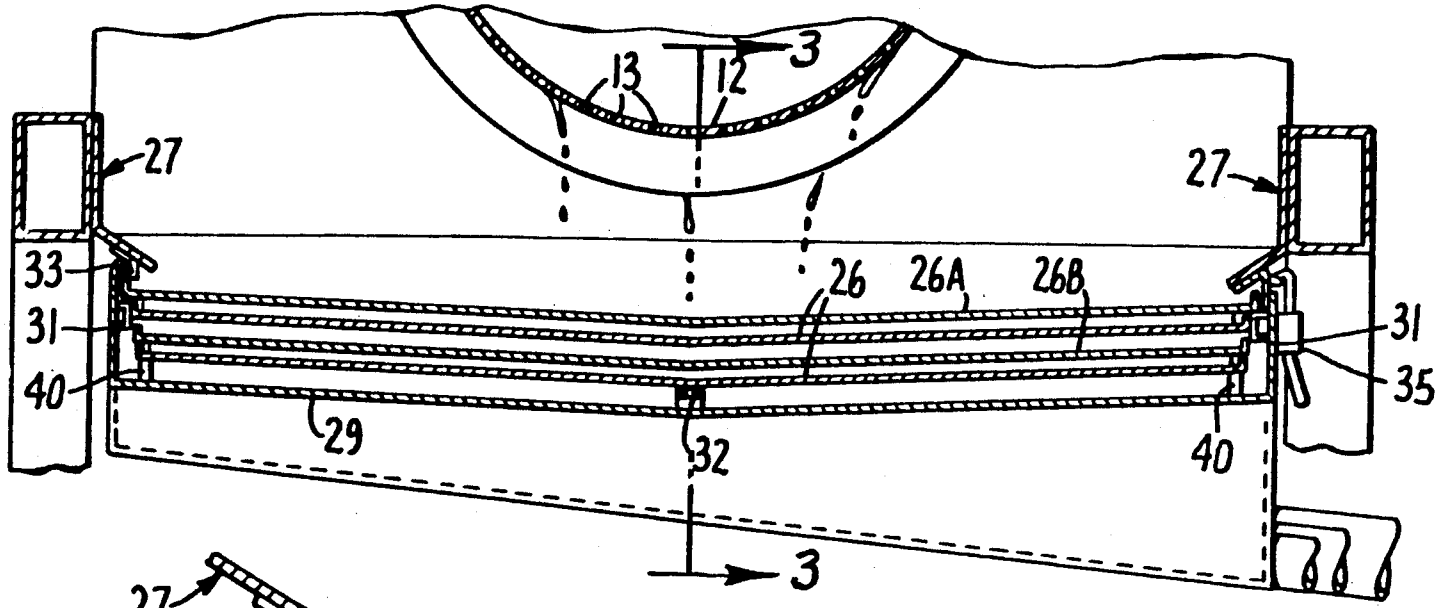
FIG. 5 is an enlarged fragmentary cross-sectional view taken substantially on the plane of line 5—5 of FIG. 1.
Figure 6:
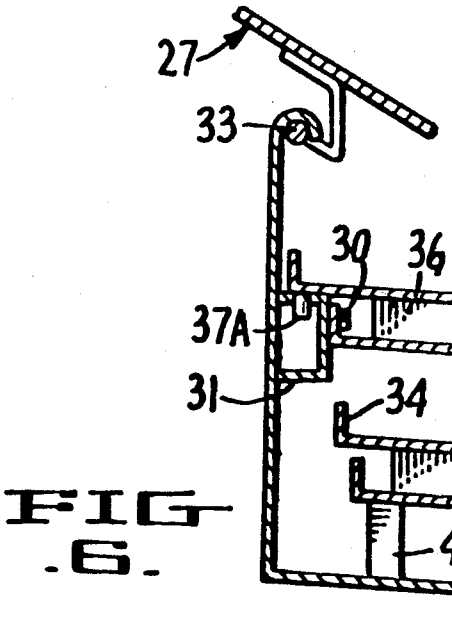
FIG. 6 is a fragmentary cross-sectional view corresponding to the left-hand portion of FIG. 5 but on a greatly enlarged scale to show features of construction.
Figure 7:
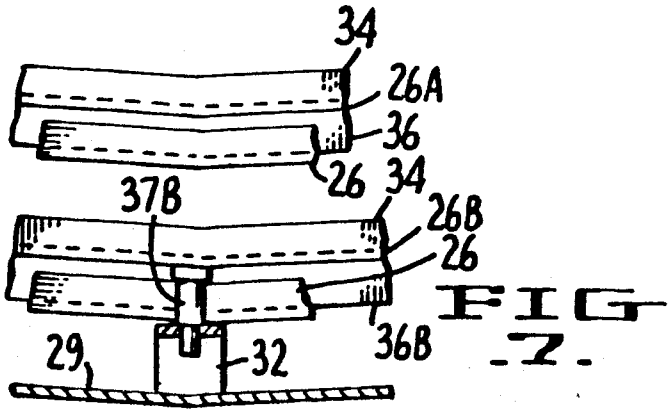
FIG. 7 is a vertical cross-sectional view corresponding to the center portion of FIG. 5 but on a greatly enlarged scale to illustrate features of construction.

Each of the drip pans 26 is of flattened V-shaped transverse cross-section for channeling the juice flowing down over the drip pans toward the longitudinal center lines thereof. Also, as may be best seen in FIG. 2 of the drawings, each drip pan is formed with upwardly projecting flanges 34 along its upper edge and lateral sides for confining juice falling onto the drip pan and channeling such juice to then fall over the lower edge of the drip pan, the lower edge being formed with a downwardly projecting flange 36.

As may best seen in FIGS. 3 through 7, the adjustable drip pan 26A is supported at its sides on elongated brackets 31. Drip pan 26A is releasably fastened in the desired position on elongated brackets 31 by engaging downwardly projecting pin 37A in a series of openings 38A formed along the upper side of the bracket 31. The drip pan 26 immediately subjacent adjustable drip pan 26A is fixedly secured at its opposite sides to bracket 31 with its lower edge positioned to discharge any juice flowing down such drip tray into the collector trough 28A. Thus, as may be seen in FIG. 1 of the drawings, with adjustable pan 26A positioned to receive juice from barrel 12 at the desired position therealong, the juice will run down tray 26A, then fall onto subjacent fixed tray 26 and be discharged therefrom into collector trough 28A.

The structure of adjustable drip tray 26B is similar to that of drip tray 26A except that adjustable drip tray 26B receives juice from barrel 12 only at the area between the upper end of drip pan 26A and the upper end of drip pan 26B, and adjustment is accomplished by engaging downwardly projecting pin 37B in openings 38B formed along bracket 32. The fixed drip pan 26 immediately underlying adjustable drip pan 26B has its lower edge formed to discharge juice thereon into collector trough 28B. Thus, juice dropping from barrel 12 between the upper end of drip pan 26A and the upper end of drip pan 26B will fall onto drip pan 26B and thence onto the underlying fixed drip pan 26 and into collector trough 28B.

Any juice falling from barrel 12 beyond the upper edge of adjustable drip pan 26B (to the left as viewed in FIG. 1) drops into flattened trough 27 and on into receiving trough 28C. Thus, in the form of the invention shown in the drawings, the juice falling from barrel 12 is separated into three grades of juice, and the quality of each grade can be varied by adjusting drip pans 26A and 26B.

A plurality of open top distributing troughs 39 are mounted to extend longitudinally of the barrel 12 below the receiving troughs 28 for connection to distributing pipes 41 leading to storage tanks or the like (not shown). Control means 42 is provided for selectively discharging the contents of the receiving troughs 28A, 28B and 28C into selected ones of the distributing troughs 39A and 39B.

Figure 8:
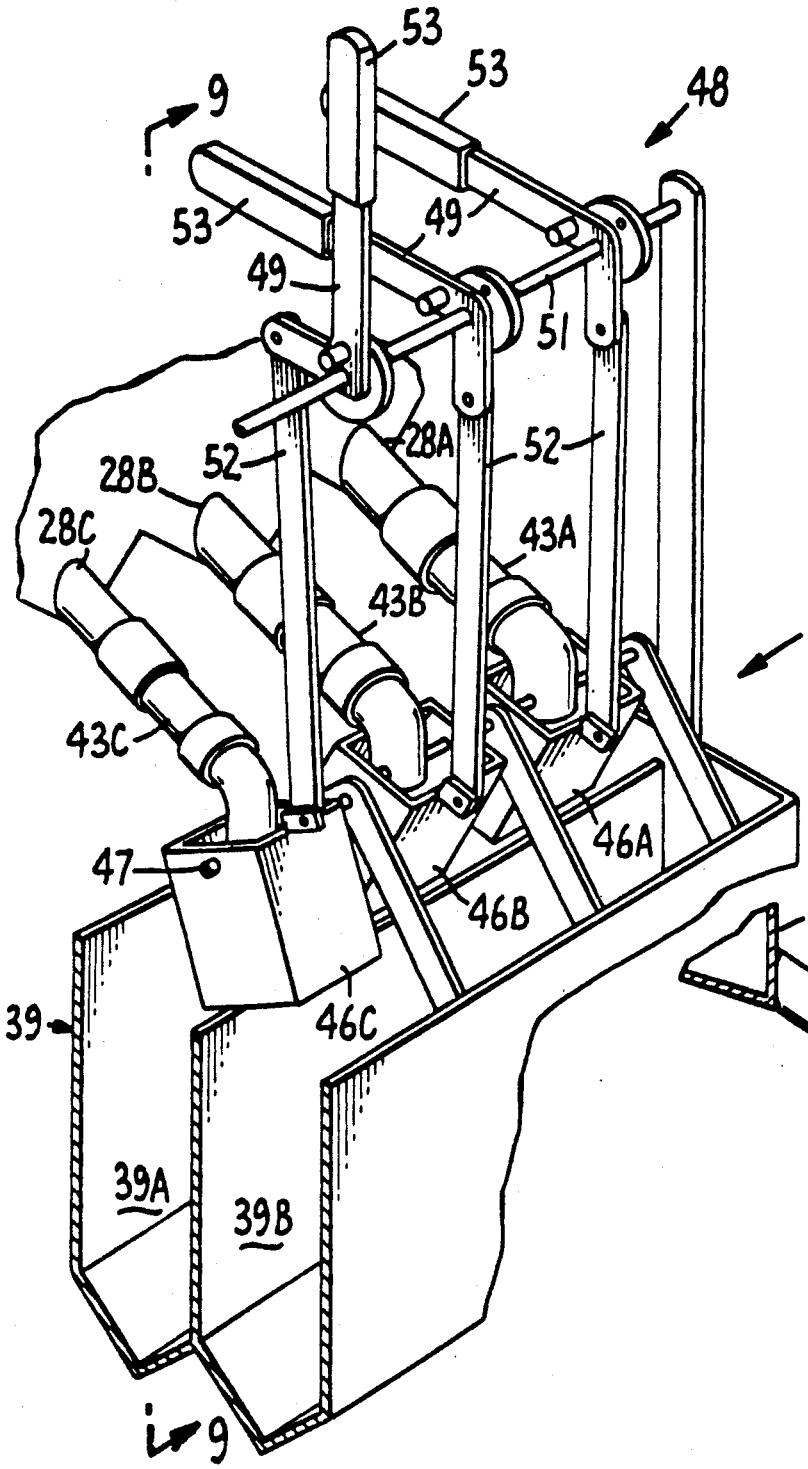
FIG. 8 is a perspective view of a control device forming a portion of the apparatus of the present invention with associated fragmentary portions of the other structure.

Control means 42 includes conduits 43A connected to the discharge openings of receiving troughs 28A, 28B and 28C, respectively, see FIG. 8. The conduits 43A through 43C each have a discharge end overlying the divider 44 between the adjacent distributing troughs 39A and 39B. Diverter tubes 46A, 46B and 46C are mounted in position for their open upper ends to receive juice from the discharge ends of the conduits 43A, 43B and 43C respectively.

Figure 9:
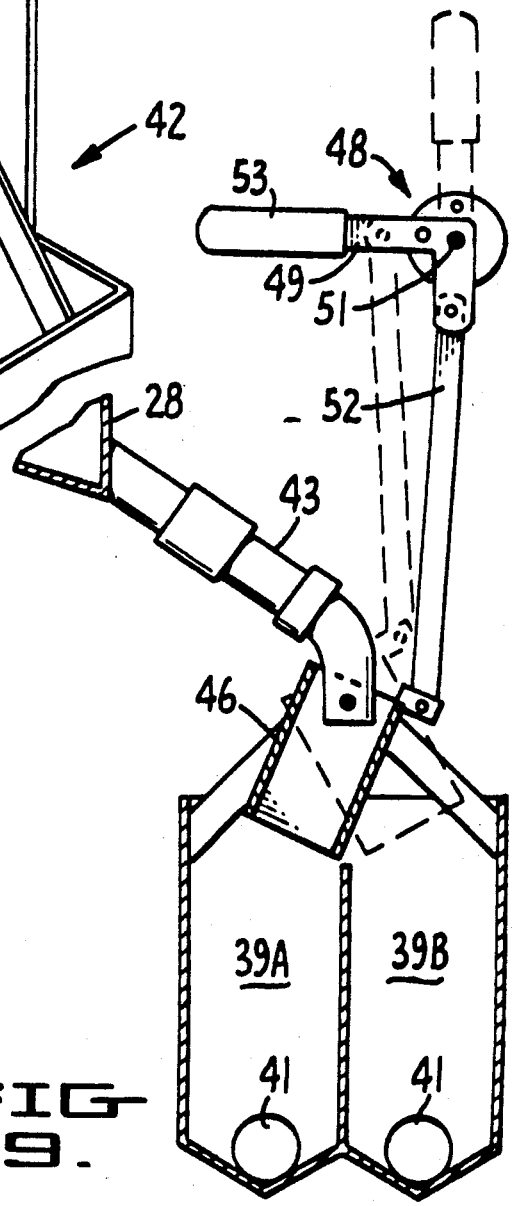
FIG. 9 is a vertical cross-sectional view taken substantially on the plane of Line 9—9 of FIG. 8.

The diverter tubes 46A, 46B and 46C are pivotably mounted on a rod 47 to rock between terminal positions (illustrated in solid lines and phantom lines in FIG. 9 of the drawings) emptying into one or the other of the adjacent distributing troughs 39A and 39B for selectively diverting juice from the conduits 43A, 43B and 43C to the desired distributing trough.

Means 48 is provided for effecting rocking of the diverter tubes 46A, 46B and 46C individually between their terminal positions. The means 48 may best be seen in FIGS. 8 and 9 of the drawings and, as there shown, provides individually bell cranks 49 pivotally mounted on a rod 51. The bell cranks 49 are each connected by a link 52 to the diverter tubes 46A, 46B and 46C, handles 53 being provided on the distal ends of bell cranks 49 for manual operation.

The method of the present invention, in one aspect thereof, involves placing colored grapes in the dejuicer, collecting the juice from the dejuicer at positions therealong where only clear, non-colored juice is expressed, and making white wine from such clear, non-colored juice. In another aspect, the method of the present invention involves placing a plurality of drip pans below an inclined cylindrical dejuicer, conducting juice caught by such drip pans to desired facilities, and adjusting at least some of the drip pans longitudinally of the cylindrical dejuicer to determine the average grade of juice collected by each of such drip pans.

From the foregoing, it will be seen that the novel method and apparatus of the present invention makes possible adjustable classifying of grape juice emanating from an inclined cylindrical dejuicer into a plurality of grades, with the operator having control over the characteristics of each grade, and further makes it possible to separate and collect clear, non-colored grape juice from such a dejuicer filled with colored grapes so that white wine may be made from the juice of colored grapes.

I claim:

1. A continuous action grape dejuicing and classifying machine, comprising an inclined perforated cylindrical barrel, an expressor having helical flights extending along the length of said barrel and rotatable therein for progressively squeezing grapes fed into said barrel to extract their juice, means for rotating said helical flights of said expressor at a desired speed, a plurality of substantially parallel flattened juice receiving pans supported in inclined generally parallel vertically spaced relation underneath the portions of said barrel from which juice emanates during squeezing of the grapes, a plurality of open top receiving troughs mounted to extend transversely of said barrel in side-by-side relation beneath the lower ends of said pans to receive juice therefrom, at least one of said pans being slideably adjustable on said support means longitudinally of said barrel so as to receive "first pressing" juice from said barrel up to a desired station therealong and to deflect such juice to a first one of said receiving troughs, and a flattened trough extending along said barrel from the upper end thereof below said pans and formed for receiving the juice from the barrel not falling on said slideably adjustable pan and for channeling such juice to another one of said receiving troughs.

2. A grape dejuicing and classifying machine as described in claim 1, and wherein said juice receiving pans are formed with upwardly projecting flanges along their upper edges and sides for confining juice falling on to said pans and channeling such juice to fall over their lower edges into said receiving troughs.

3. A grape dejuicing and classifying machine as described in claim 1, and wherein said juice receiving pans are of flattened V-shaped transverse cross-section for channeling the juice flowing down over each such pan toward the longitudinal centerline thereof.

4. A grape dejuicing and classifying machine as described in claim 1, and wherein a non-slideably adjustable flattened juice receiving pan is fixedly mounted in parallel spaced relation below each of said slideably adjustable pans in position to receive juice from their lower edges at all positions of said slideably adjustable pans, said non-slideable pans having their lower edges positioned to discharge juice therefrom into selected ones of said receiving troughs.

5. A continuous action grape dejuicing and juice classifying machine, comprising an elongated dejuicing means formed for continuously extracting juice from grapes contained therein with different grades of juice flowing from said dejuicing means at different points along its length, means for selectively collecting the different grades of such juice and drip pan apparatus comprising a plurality of substantially parallel flattened juice receiving pans, support means formed for supporting said pans in inclined generally parallel vertical spaced relation underneath the portions of said barrel from which juice emanates during squeezing of the grapes, a plurality of open top receiving troughs mounted to extend transversely of said barrel in side by side relation beneath the lower ends of said pans to receive juice therefrom, at least one of said pans being slideably adjustable on said support means longitudinally of said barrel so as to receive "first pressing" juice from said barrel up to a desired station therealong and deflect such juice to a first one of said receiving troughs, a flattened trough extending along said barrel from the upper end thereof below said pans and formed for receiving the juice from the barrel not falling on said slideably adjustable pan and for channeling such juice to another of said receiving troughs, a plurality of open top distributing troughs mounted to extend longitudinally of said barrel below said receiving troughs and adapted for connection to distribution pipes leading to storage tanks, and control means for selectively discharging the contents of said receiving troughs into selected ones of said distributing troughs.

6. A grape dejuicing and classifying machine as described in claim 5, and wherein said control means comprises conduits from each of said receiving troughs having a discharge end overlying a divider between adjacent distributing troughs, a diverter positioned to receive juice from each of the said discharge ends of said conduits, said diverters being pivotally mounted to rock between terminal positions emptying into said adjacent distributing troughs for selectively diverting juice from said conduits to selected ones of said distributing troughs, and means for effecting rocking of said diverters individually between said terminal positions.

* * * * *